United States Patent [19]

Dallmaier

[11] Patent Number: 4,679,743

[45] Date of Patent: Jul. 14, 1987

[54] APPARATUS FOR WINDING CABLE ON CABLE DRUMS

[75] Inventor: Gunter Dallmaier, Hanover, Fed. Rep. of Germany

[73] Assignee: Paul Troester Machinenfabrik, Hanover, Fed. Rep. of Germany

[21] Appl. No.: 864,589

[22] Filed: May 16, 1986

[30] Foreign Application Priority Data

May 17, 1985 [DE] Fed. Rep. of Germany ..... 3517696

[51] Int. Cl.[4] ..... B21C 47/24; B65H 49/24; B65H 54/553

[52] U.S. Cl. ..... 242/54 R; 242/79; 242/129.51

[58] Field of Search ..... 242/58.6, 68.4, 79, 242/54 R, 129.51

[56] References Cited

U.S. PATENT DOCUMENTS

| | | | |
|---|---|---|---|
| 1,874,904 | 8/1932 | Crafts | 242/58.6 |
| 2,652,207 | 9/1953 | Goedken | 242/58.6 |
| 3,329,369 | 7/1967 | Guthrie | 242/58.6 |
| 4,098,468 | 7/1978 | Skalleberg | 242/54 R |
| 4,165,052 | 8/1979 | Seibert | 242/79 X |
| 4,209,140 | 6/1980 | Seibert | 242/79 |
| 4,460,134 | 7/1984 | Kunz | 242/68.4 |

FOREIGN PATENT DOCUMENTS

| | | | |
|---|---|---|---|
| 878303 | 6/1953 | Fed. Rep. of Germany | 242/58.6 |

*Primary Examiner*—Stuart S. Levy

*Assistant Examiner*—Joseph J. Hail, III

*Attorney, Agent, or Firm*—Robert E. Burns; Emmanual J. Lobato

[57] ABSTRACT

Apparatus for winding cable on a cable drum comprises two telescopic vertical stands mounted on under carriages and connected at their upper ends by a telescopic traverse. A first slide movable vertically by an electric motor on an vertical guideway on the upper part of each of the stands has an inclined guideway on which a second slide having a spindle for insertion into a central opening of a cable drum is slidable. In their lower positions the second slides are supported by support provided on the upper parts of the stands and, while thus supported, the second slides with their spindles are movable horizontally by vertical movement of the first slides so as to bring the spindles into alignment with central openings of a cable drum. Vertical movement of the spindles is effected by telescopic movement of the stands. After the spindles are inserted into the openings in the cable drum, the first and second slides are moved upward together so as to lift the drum which can thereupon be rotated by an arm which is rotatable about an axis of one of the spindles and has a pin engageable in an off-center opening in a side of the cable drum. Control of motors for raising and lowering the first slides comprises manually operable push-button switches for individual operation of the motors and also a programmed control comprising control switches mounted on the stands and having followers engaging cam surfaces on the first slides.

11 Claims, 5 Drawing Figures

APPARATUS FOR WINDING CABLE ON CABLE DRUMS

FIELD OF INVENTION

The invention relates to apparatus for winding cable on cable drums comprising two telescopic vertical stands, each mounted on a running gear and connected at their upper ends through a telescopic traverse and each of which has a vertically slidable support for a spindle insertable in a central opening of a cable drum and for each slidable support a motor driven adjusting mechanism.

BACKGROUND OF THE INVENTION

Various forms of such apparatus for winding cable on cable drums are known. This type of construction is known as the portable type. With it, the spindles which serve as cable drum supporting pins can, by means of slides , be easily brought to the required height for inserting the spindles into the central openings of the cable drum by movement of the vertical stands toward one another through shortening of the telescopic traverse which connects them. However, with such apparatus, considerable difficulty has been experienced in obtaining the required exact alignment of the axis of the cable drum with the axis of the spindle. The cable drums are frequently so heavy that they cannot be put in the required position by human force. Hence various possibilities of aligning the cable drum mechanically have been proposed. One of these proposals is that a pit is provided in the floor of the factory in which two rollers are supported parallel to a center line which lies exactly vertically under the spindle axis. This is a high additional construction cost which is increased in that a cover must be provided so that removal of the still heavier wound cable drum is not hindered by the rollers.

Another form of construction, works with a bar which extends through the central opening of the cable drum and which is put in the required position by lifting by means of crank arms.

The possible arrangement of a cross slide increases the cost of construction and the space required. Moreover, two motors are necessary for each of the pairs of slides provided on both sides of the gantry. Because of the high weight of the cable drum, the slides, in particular the horizontal slides, must be correspondingly robust.

SUMMARY OF THE INVENTION

The invention avoids the disadvantages of the present state of technology. It is an object of the invention to provide a very simple, low-cost, compact apparatus for aligning the cable drum.

In accordance with the invention, each slide is arranged with a further spindle-carrying slide and is connected with it through a slide guide running at an acute angle to the horizontal. Beneath the further slide there is arranged on the stand a limit stop which serves as a support for the further slide and, on the motor-driven slide, there is provided a stop limiting downward movement of the further slide.

Thus also here, a pair of slides is provided on each side of the gantry. However, each pair of slides is driven by a single drive motor. By reason of the inclined arrangement of the slide guides, these slides can be constructed with relatively little material and very stabile.

Moreover, through the inclination of the slide guides, extraordinarily little space is required for each pair of slides. Through the inclined arrangement of the slide guide, there is obtained special kinematics for aligning each side of the drum. The heavy drum resists the movement of its axis in a horizontal plane so long as both sides of the drum lie on the floor. But as a vertical component of movement is exerted on the spindle-carrying slide through the inclined slide guide and the motorized vertical lift of the slide between the spindle carrying slide and the stand, the cable drum on the side on which the spindles are to be aligned by the turning of the motor on the cable drum side walls, will be given not only a horizontal but also a vertical movement. If the spindles cannot be moved horizontally because this is hindered by the circumferences of the side walls of the cable drum standing on the floor, then these side walls of the cable drum are lifted slightly so that the horizontal movement can occur. This apparatus is simple in construction, favorable cost wise, simple in maintenance and easily usable.

It is advantageous when the stop arranged below the further slide is formed as a roller supported by a holder. The force required for the horizontal movement is thereby decreased.

It is advantageous to provide such apparatus with a programmed control. During actuation together of the two slide-moving motors on each side of the gantry for lifting the cable drum to the winding position and for lowering the cable drum after it is fully wound, each motor is advantageously individually actuated for alignment of the cable drum. Hence, it is advantageous when there is provided a controller which is actuated in that region of movement of the slide in which the further slide is in contact with the stop, so that through this controller the programmed control is given information that the spindle-carrying slide is in correct position.

It is advantageous when the controller is coordinated with the motor-driven slide and has a feeler which engages a control curve on this slide.

It is advantageous when the controller part is an electrical program control with which in the control position of this control the two-sided actuation of both slide motors is transposed on the single actuation of one motor.

BRIEF DESCRIPTION OF THE DRAWINGS

The nature, objects and advantages of the invention will be more fully understood from the following description of a preferred embodiment shown by way of example in the drawings in which:

FIG. 5 is an enlarged side elevation corresponding to FIG. 4 and showing another embodiment of programmed switch control.

DESCRIPTION OF PREFERRED EMBODIMENT

Figure 1:
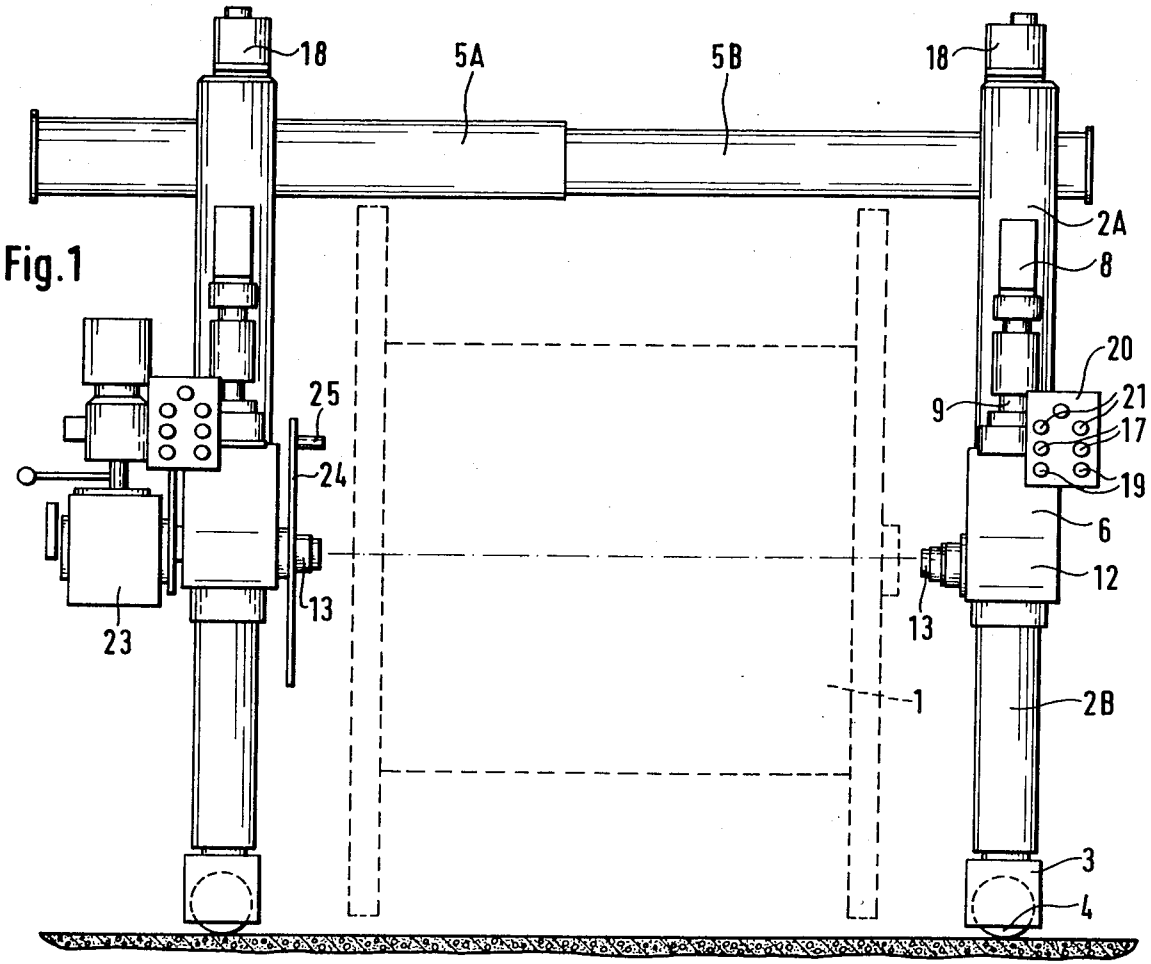
FIG. 1 is a front elevation of apparatus for winding cable on cable drums in accordance with the present invention.
Figure 3:
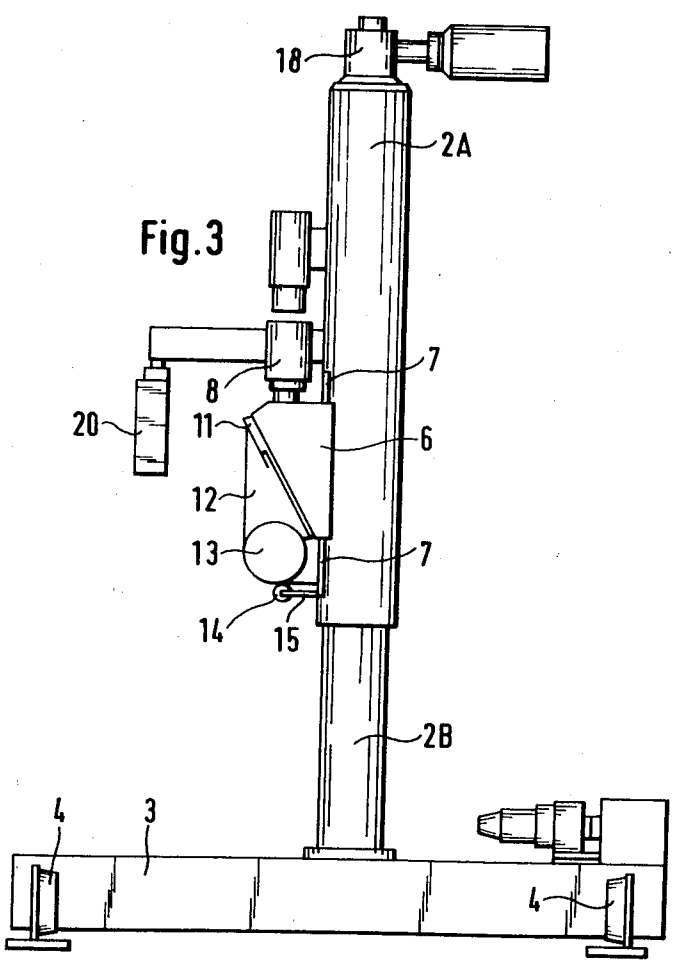
FIG. 3 is a side elevation thereof from the opposite side.
Figure 2:
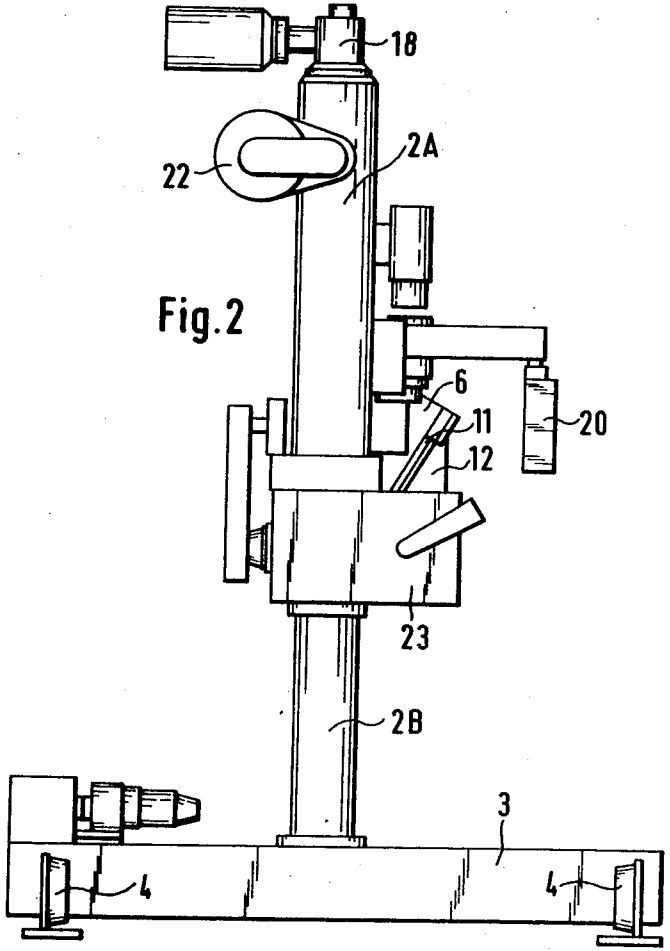
FIG. 2 is a side elevation thereof from one side.

As shown by way of example on the drawings, an apparatus for winding cable on a cable drum 1, (FIG. 1)

comprises two telescopic vertical stands 2 of which the lower part 2B is slidable in an upper part 2A. The lower part 2B is mounted on a running gear 3 of which wheels 4 run on rails which are installed in or on the factory floor. The upper parts 2A of the two stands 2 are connected with one another by parts 5A and 5B of a telescopic traverse 5. These parts of the traverse 5 are slidable in one another, as the tube forming the traverse part 5A has a larger diameter than the tube forming the other traverse part 5B. On the upper part 2A of each of the stands 2, there is arranged a vertically slidable slide 6 which is guided by a vertical slide guide 7. This slide 6 is movable vertically on the slide guide 7 by means of a motor 8 having a screw threaded. shaft 9 which engages in a nut 10 fixed on the slide 6. This vertically slidable slide 6 carries an inclined slide guide 11 on which a further slide 12 which carries the spindles 13 is slidable. The slide guide 11 is disposed at an acute angle to the horizontal and well as to the verical. The further slide 12 is limited in its movement on the slide guide 13 on the one hand through engagement with a roller 14 carried by a support 15 on the upper part 2A of the stand 2 and on the other hand by abutments 16 so arranged as to limit movement of the further slide downwardly as well as upwardly.

Figure 4:
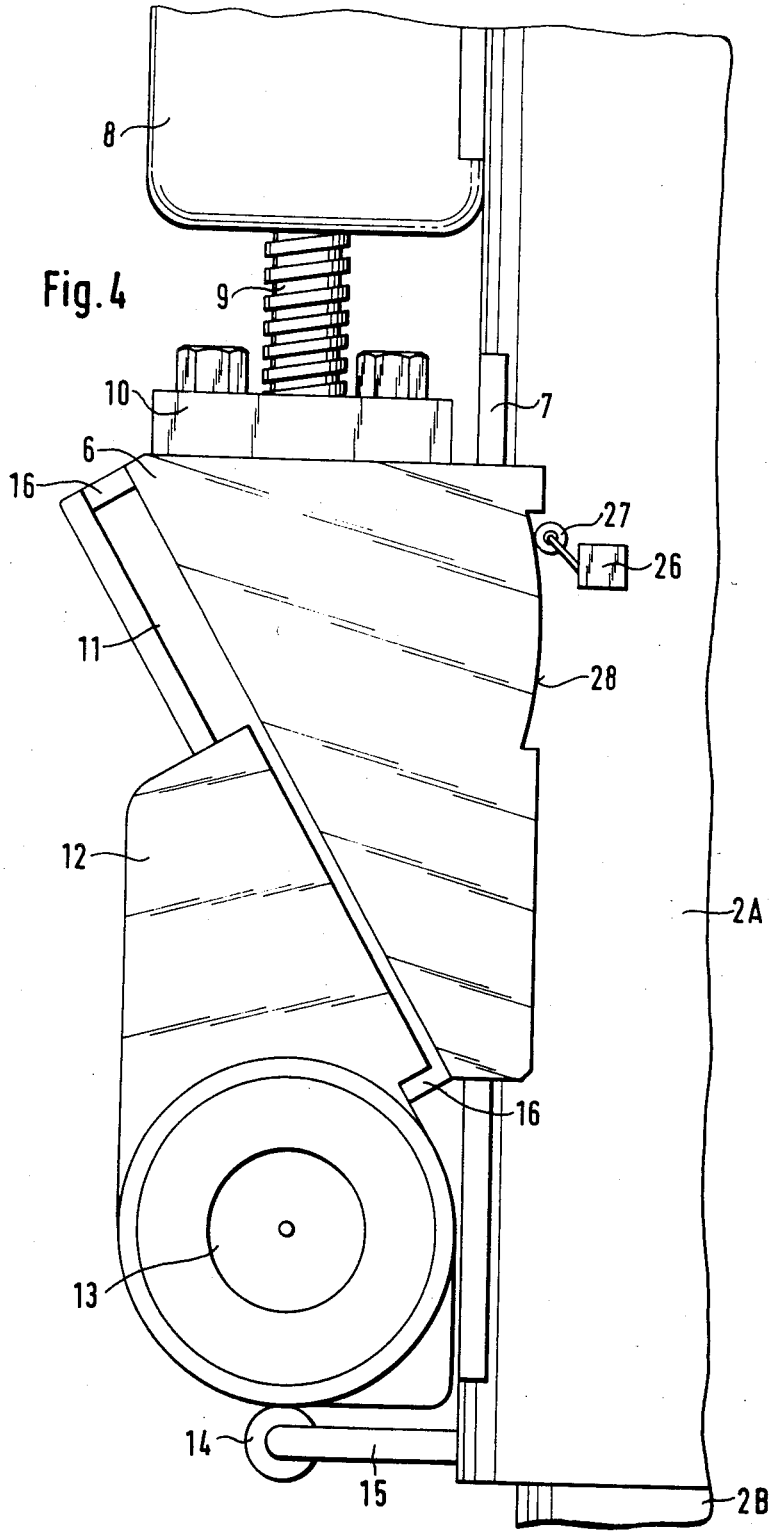
FIG. 4 is an enlarged partial side elevation corresponding to a portion of FIG. 3 and showing programmed switch control.

Through the co-operation of this pair of slides 6, 12, movement of the spindle 13 vertically as well as horizontally can be achieved. If the slide 6 is moved downwardly from the position shown in FIG. 12, it presses slide 12 with its lower edge lying on the roller 14 towards the left since the slide 12, by reason of its engagement with the roller 14, cannot move further downwardly. Thus, through vertical movement of the slide 6, a horizontal movement of the slide 12 and thereby simultaneously a horizontal movement of the spindle 13 is achieved. Through upward movement of the upper parts 2A of the stand 2, the roll 14 on the support 15 can be positioned in such a position that the spindle 13, through support of the slide 12 on the roller 14, is positioned at the required height for entry into the central opening of the cable drum 1. This adjustment of the upper part 2A of the stand 2 is achieved through actuation of the electric push-button switch 17 which controls the relay for actuation of the electric motor 18. If the spindle 13 is at the correct height position, the electric button switch 19 on the switchboard 20 is actuated. With this electric push-button switch 19, the relay for actuation of the motor 8 is actuated. Through lowering of the slide 6, the slide 12 is moved laterally towards the left as seen in FIG. 4 until the spindle is exactly aligned with the central opening of the cable drum 1. Then, through actuation of the electric push-button switch 21, motor 22 is actuated through a relay so as to shorten the traverse between the stands 2, whereby the spindles 13 are introduced into the central openings of the cable drum. Finally, motors 8 of both stands are put in operation in opposite directions whereby the slides 6 are raised and thereby the slides 12 are moved towards the right until they engage the abutment 16. Then, through further lifting of the slide 6, the slides 12 are also raised, being supported on the abutments 16. Now, the cable drum hangs freely on the spindle 13 and can be rotated by motor 23 through rotating lever 24 which carries a pin 25 which engages in an opening provided for it in the side wall of the cable drum.

On the stands 2, there is provided a control switch 26 having a sensing lever 27 engaging a cam surface 28 on the slide 6. While this cam control switch controls programmed control of the slide 6, the necessary vertical and horizontal movements of the spindles 13 can be controlled manually by means of the electric push-button switches 17 and 19 on the switchboard 20.

As illustrated by way of example in FIG. 4, the control switch 26 is a limit switch which switches the motor 8 off as soon as the end positions of the slide 6 are reached. In FIG. 5, there is shown a further embodiment in which the control switch 26 is replaced by three swtiches 26A,26B and 26C. When, through manual control, the spindles 13 are to be moved horizontally (through vertical movement of the slides 6) in order to bring them into alignment with central holes in the sides of the cable drum, the switches 26A and 26B serve as limits for the horizontal movement of the spindles 13. When the cam surface 28 reaches the control lever 27 of switch 26A, the spindle 13 is moved horizontally furthest from the stand 2. If, after insertion of the spindles 13 in the openings in the side walls of the cable drum, the spindles 13 are to be moved back toward the stand 2, the switch 26B switches current to the motor 8 off until also the switch 26B on the opposite side of the opposite stand 2 has actuated its respective switch 26B. Only when both switches 26B are actuated, can the two motors 8 on the both stands 2 be again put in operation in order to lift the cable drum from the floor. Both motors then work simultaneously until the curve 28 reaches the switch 26C. This limits the end of the movement. In other words, between the switches 26A and 26B a horizontal movement of the spindle takes place (on each stand individually or, if desired, both together); between the switch 26B and 26C, a common vertical movement of both spindles takes place.

What is claimed is:

1. Apparatus for winding cable on a cable drum comprising;

two telescopic vertical stands each comprising an upper part and a lower part movable vertically relatively to one another, motor means for raising and lowering said upper part relative to said lower part, undercarriage means supporting said lower part vertically and a vertical guideway on said upper part, a horizontal telescopic traverse connecting said upper parts of said stands with one another with said stands spaced to accommodate a cable drum between them and means for varying the effective length of said traverse to vary the spacing between said stands, a first slide slidable on said vertical guideway of each of said stands, motor means for moving each of said first slides vertically of the respective guideway and an inclined guideway on each of said first slides, said inclined guideway being at an acute angle to the vertical and to the horizontal, a second slide slidable on each of said inclined guideways and a spindle on each of said second slides, said spindles being of a size and shape to be received in central holes in opposite sides of a cable drum, support means on each of said stands below said second slide for engagement by said second slide, and abutments on said inclined guideways of said first slides for engagement by said second slide to limit the movement of said second slides relative to said first slides.

2. Apparatus according to claim 1, in which said support means comprises a roller on an arm projecting from said upper part of said stand and engageable by said spindle, whereby said spindle can be moved horizontally by vertical movement of said first slide.

3. Apparatus according to claim 1, in which abutments on said inclined guideways include lower abutments limiting upward movement of said first slide relatively to said second slide, whereby said first and second slides are movable upward together when said second slides are in engagement with said lower abutments.

4. Apparatus according to claim 1, in which said spindles are rotatable and in which a motor driven arm rotatable about an axis of one of said spindles carries a pin engageable in an off-center opening in a side wall of a cable to rotate said cable drum.

5. Apparatus according to claim 1, in which said means for moving each of said first slides vertically comprises a motor and means for controlling said motor, said motor control means comprising means providing a programmed control of the vertical movement of said first slides.

6. Apparatus according to claim 5, in which said motor is an electric motor mounted of said upper part of each of said stands, said motor having a vertical threaded shaft, and in which a nut engaging said threaded shaft is secured on said first slide.

7. Apparatus according to claim 5 in which said programmed control means comprises a cam surface on said first slide and switch means mounted of said upper part of said stand and having a follower engageable with said cam surface.

8. Apparatus according to claim 5, in which said programmed control means comprises a cam surface on said first slide and three control switches having followers engageable with said cam surface.

9. Apparatus according to claim 8, in which said control switches comprises switches for limiting horizontal movement of said second slide by vertical movement of said second slide.

10. Apparatus according to claim 8, in which said control switches comprise switches for effecting common vertical movement of both of said second slides and thereby common vertical movement of both spindles to a cable drum.

11. Apparatus according to claim 5, in which said motor control means comprises manually operable means for controlling said motors individually.

* * * * *